US006675547B1

(12) United States Patent
Golcheh

(10) Patent No.: US 6,675,547 B1
(45) Date of Patent: Jan. 13, 2004

(54) METHOD FOR FORMING A HEAD WALL FROM AN ANCHOR PILE AND REINFORCING MEMBER FOR SAID ANCHOR PILE STRUCTURE

(76) Inventor: Joseph Golcheh, 77, rue Edouard Vaillant, 69100 Villeurbanne (FR)

( * ) Notice: Subject to any disclaimer, the term of this patent is extended or adjusted under 35 U.S.C. 154(b) by 66 days.

(21) Appl. No.: 09/787,903

(22) PCT Filed: Jul. 31, 2000

(86) PCT No.: PCT/FR00/02196

§ 371 (c)(1),
(2), (4) Date: Aug. 7, 2001

(87) PCT Pub. No.: WO01/09439

PCT Pub. Date: Feb. 8, 2001

(30) Foreign Application Priority Data

Jul. 30, 1999 (FR) ..... 99 10099
Jul. 30, 1999 (FR) ..... 99 10098

(51) Int. Cl.[7] ..... E02D 29/02

(52) U.S. Cl. ..... 52/741.13; 405/286; 405/284; 52/660; 52/664; 52/596; 52/603

(58) Field of Search ..... 52/598, 596, 603, 52/612, 434, 719, 676, 660, 663, 664, 741.13; 405/284, 286, 272, 258

(56) References Cited

U.S. PATENT DOCUMENTS 4,470,728 A 9/1984 Broadbent
4,929,125 A 5/1990 Hilfiker
5,525,014 A 6/1996 Brown
5,807,030 A 9/1998 Anderson et al.
5,865,005 A 2/1999 Cataldo

FOREIGN PATENT DOCUMENTS

| | | |
|---|---|---|
| CH | 621174 | 1/1981 |
| DE | 2926302 | 1/1981 |
| DE | 4104045 | 7/1991 |
| EP | 0492975 | 7/1992 |
| EP | 0699805 | 3/1996 |
| GB | 2216933 | 10/1989 |
| JP | 56142936 | 11/1981 |
| JP | 8209703 | 8/1996 |

*Primary Examiner*—Carl D. Friedman
*Assistant Examiner*—Jennifer I. Thissell
(74) *Attorney, Agent, or Firm*—Dennison, Schultz & Dougherty

(57) ABSTRACT

The invention relates to the field of building and is applicable to retaining walls. The reinforcing element is characterized in that it consists in connecting the back face of the facing to the strong zone by means of a plurality of reinforcing elements (5) disposed substantially horizontally in superposed planes, and in selecting said elements in such a manner that each of them comprises an anchoring portion that is included in the strong zone and that is constituted by a mesh comprising more than two longitudinal bars, of which only some extend as far as the facing to define a portion that works in traction, which portion has an attachment part for connection to the facing at its end remote from the anchoring portion.

22 Claims, 7 Drawing Sheets

METHOD FOR FORMING A HEAD WALL FROM AN ANCHOR PILE AND REINFORCING MEMBER FOR SAID ANCHOR PILE STRUCTURE

TECHNICAL FIELD

The present invention relates to the field of supporting or retaining natural or artificial masses of more or less movable material that, due to erosion, vibration, cracking, or cleavage, is liable to suffer from landslides that are harmful to themselves and/or to the surroundings.

Although numerous implementations can be envisaged, a preferred application of the invention lies in retaining the front faces of earthworks that are cut or filled relative to a site to be protected, in particular roadways or railway lines, without this list being exhaustive.

PRIOR ART

To solve the above problem, various technical proposals have been made based on the idea that it is appropriate to raise a screen in the form of a wall that performs the function of retaining a mass of material behind an upstream, back, or "wrong" face.

It is rapidly apparent that such screens need to withstand horizontal stresses coming from the retained earth.

To satisfy that requirement, one prior technical proposal is to make screens in form of gravity walls, by analogy with the design that has been developed for making water-retaining dams. In that concept, the wall's own weight is the only element providing resistance against the thrust to be withstood.

Although such walls are capable of achieving the intended objective, they are heavy and expensive to construct and in practice they are unsuitable for use with heights that are relatively large or in sites that present difficulties for moving heavy and powerful hoisting equipment.

It has been envisaged to make the mass of material itself contribute to enabling the screen or wall to withstand thrust. Thus, proposals have been made to implement the screen in the form of a thin web that can be vertical or sloping rising from an integral or separate footing possessing an upstream portion referred to as a "heel" which is buried in the material that is to be retained and which thus serves to provide anchoring. In general, counterforts are provided on the back face of the web to contribute to its mechanical strength.

Such a proposal appears to be more practical and less expensive, but it still gives rise to problems when it is necessary to satisfy retention requirements over a great height.

In addition, it can be observed that such proposals give no opportunities for improving the appearance of the front face of the retaining wall, e.g. by including niches for plants.

Another prior art technique proposes building retaining screens from stackable prefabricated modules.

For relatively low heights, such proposals are generally satisfactory. However, the use of stackable prefabricated modules does not make it possible to control the forces that act on them by means of the mass of material that is to be contained.

Thus, developments of the prefabricated module technique have given rise to the addition of reinforcing elements based on the reinforced earth technique, and comprising anchoring means which are inserted in the mass of material to be contained and which are also attached to the stackable prefabricated modules in such a manner as to be capable of working in traction.

The subject matter of the invention relates to that particular technique for reinforcing retaining walls.

The techniques that have been proposed for reinforcing retaining walls constituted by stackable prefabricated modules make use of several proposals.

One of them consists in securing the back face of the retaining wall to a welded wire mesh which is incorporated in various substantially horizontal planes superposed within the material to be contained.

Such a technique is not easy to implement and gives rise to a problem of distributing forces amongst the various attachment points between the mesh and the modules. It has been found that the very use of this technique causes different attachment points to be stressed differently and as a result that are uncontrollable force distributions that lead to zones of the retaining wall being associated with portions of the mesh that are not anchored or that are poorly anchored in the material to be contained.

Proposals have also been made, in particular in international patent application WO 94/23136 to make each reinforcing element in the form of two longitudinal bars that are united by spacers and form at one end loops or the like which constitute attachment parts that can be secured to the back face of the facing by means of bars fitted in appropriate manner to all or some of the stacked prefabricated modules.

That solution is found to be unsatisfactory in many respects.

Firstly, making a reinforcing element on that principle is relatively expensive since the element has the same structure over its entire length and because it needs to be anchored over its entire length by means of the materials that are to be contained.

Given this requirement, the cost price of making it is not negligible due to the raw materials used and the cost of fabrication.

In addition, account needs to be taken of standards which put a limit on the spacing of the bars constituting such elements at a determined value which is generally about 15 centimeters (cm). When such an element is to be used for interconnecting two prefabricated modules that are placed side by side, it is necessary to provide through holes for passing the vertical bars, which holes are situated at a short distance from the transverse edges of such modules. This unavoidably gives rise to a risk of breakage under tension because of the relatively small mass presented locally by the prefabricated modules.

An object of the invention is to propose a novel method of constructing a retaining wall so as to overcome the drawbacks associated with prior methods.

Another object of the proposal of the invention is to provide a novel reinforcing element suitable for overcoming the above-mentioned drawbacks while being capable of providing an improved reinforcing function by establishing a higher anchoring force while using an element that is simple, quickly made, and low in cost.

To achieve the above objects, the invention provides a method of reinforcing a retaining wall comprising a facing made up of juxtaposed component elements in front of a mass to be retained, which mass comprises immediately behind the facing an "active" zone behind which there is a "strong" zone, the two zones being considered as meeting in a boundary zone defined by a pseudo-plasma potential slip surface whose distance from the back face of the facing increases going from the base to the top of the retaining wall, the method being characterized in that it consists in connecting the back face of the facing to the strong zone by means of a plurality of reinforcing elements disposed substantially horizontally in superposed planes, and in selecting said elements in such a manner that each of them comprises an anchoring portion that is included in the strong zone and that is constituted by a mesh comprising more than two longitudinal bars, of which only some extend as far as the facing to define a portion that works in traction, which portion has an attachment part for connection to the facing at its end remote from the anchoring portion.

The invention also provides a reinforcing element enabling the above method to be implemented, such an element being characterized in that the anchoring portion included in the strong zone is constituted by a mesh comprising more than two longitudinal bars, only some of which extend as far as the facing to define a portion that works in traction and that presents, remote from the anchoring portion, an attachment part for attachment to the facing.

The invention also provides a retaining wall made by the method of the invention and with at least some reinforcing elements of the invention.

Thus, the retaining wall of the type comprising horizontally and/or vertically juxtaposed prefabricated elements to form a facing secured to a mass to be retained by reinforcing elements inserted in said mass is characterized in that:

- each prefabricated element comprises a plate or panel possessing a front face and a back face from which there projects at least one rib having through holes on axes orthogonal to that of the rib;
- at least one transverse bar is engaged through at least one hole in a rib of at least one element so as to extend on either side of said rib; and
- at least one reinforcing element of the invention is secured at least to said bar so as to extend substantially horizontally away from the back face and so as to be inserted in the mass to be retained, thereby acting as a portion for anchoring locally in said mass.

According to another characteristic of the invention, given the position occupied by each reinforcing element, the length of its portion working in traction is preferably equal to or greater than the distance in the corresponding horizontal plane between the back face of the facing and the corresponding local portion of the potential slip plane.

According to another characteristic of the invention, at most two longitudinal bars of the mesh constituting the anchoring portion extend as far as the facing to form the portion that works in traction.

According to another characteristic of the invention, only two longitudinal bars of the mesh extend as far as the facing to form the portion working in traction and they are spaced apart by spacers.

According to a characteristic of the invention that is different from the preceding characteristic, the portion working in traction comprises two longitudinal strips that are not interconnected.

According to a characteristic relating more particularly to the retaining wall, the attachment parts of the reinforcing element are placed in the immediate vicinity of a rib so as to reduce the bending forces applied to the transverse connection bar.

According to another characteristic of the invention, each prefabricated facing element is of a height substantially equal to the height of the level or stage of filling for which it constitutes the facing.

According to yet another characteristic of the invention, the rib of the prefabricated facing element is of a height that is less than that of said element.

According to yet another characteristic of the invention, each reinforcing element comprises two longitudinal bars forming the portion that works in traction, these two longitudinal bars being spaced apart in such a manner that their attachment parts can be placed on either side of a rib of a facing element while being situated close to said rib.

Various other characteristics appear from the following description made with reference to the accompanying drawings, which show embodiments and implementations of the invention as non-limiting examples.

BEST METHOD OF IMPLEMENTING THE INVENTION

Figure 1:
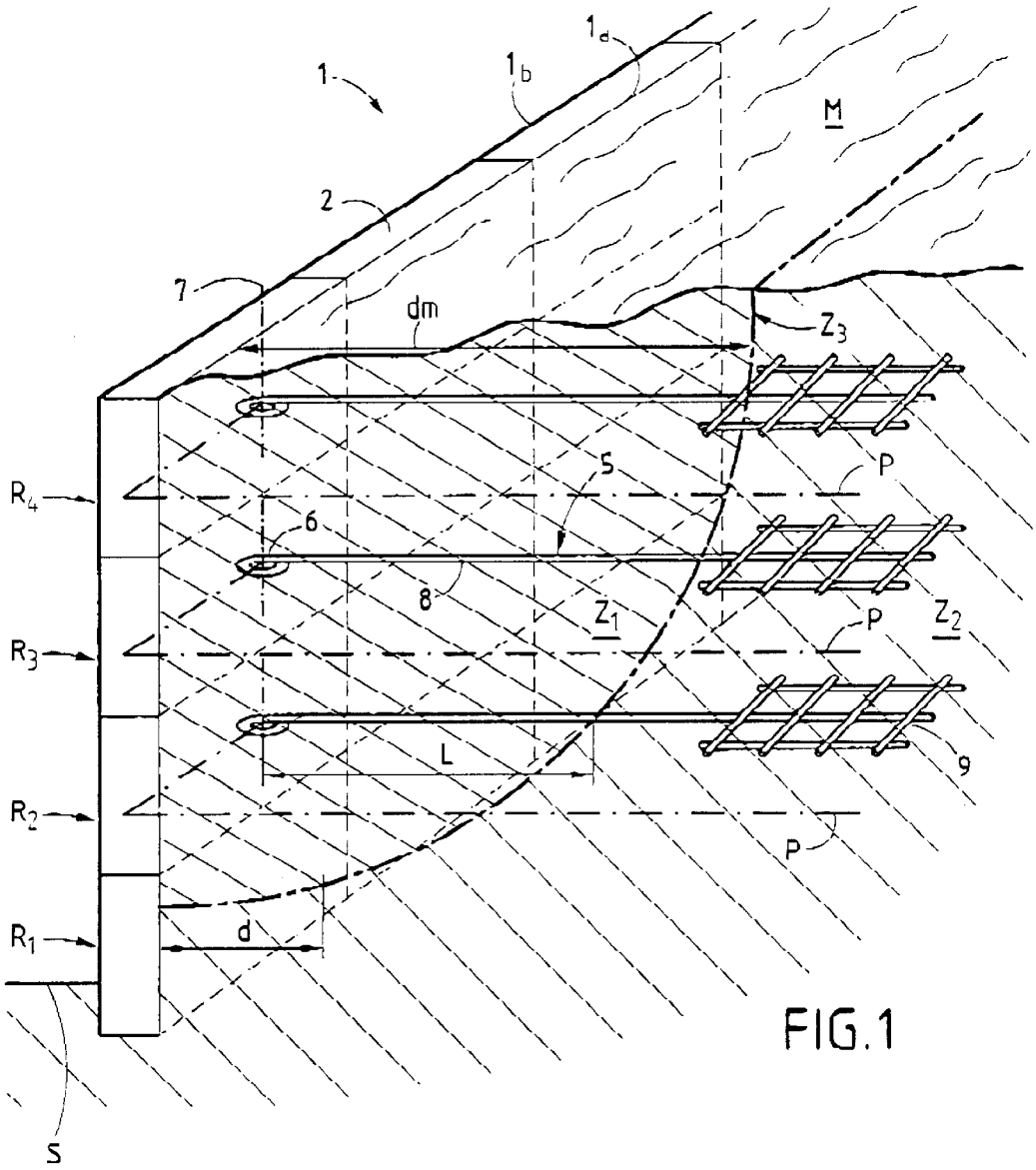
FIG. 1 is a simplified perspective view showing the retaining method of the invention.

FIG. 1 is a diagrammatic view of a retaining work given overall reference 1 and implemented in the form of a wall that rises directly or indirectly from ground S, the wall being made up by associating facing elements or modules 2, e.g. prefabricated elements or modules, which are juxtaposed in horizontal rows $R_1$, $R_2$, $R_3$, and $R_4$, for example, being stacked in directly superposed manner as shown in the perspective view, or else being interleaved using a bond such as an offset from one row to the next. It could also be envisaged to superpose the modules so that they are stepped relative to one another, e.g. back towards the mass to be retained.

Such a work which has the appearance of a wall is intended to retain a mass M which is generally constituted by a filling of earth or analogous material delivered as the wall is built up and which is generally not very compacted.

The retaining method of the wall 1 is based on the principle that a mass such as M is found not to behave in uniform manner and can be thought of as possessing an "active" zone $Z_1$ which extends from the back face $\mathbf{1}_a$ of the work 1, i.e. the face opposite from the front face $\mathbf{1}_b$ which constitutes the visible facing that needs to be suitable in appearance. In addition to the zone $Z_1$, the mass M is assumed to include a strong zone $Z_2$ constituting to a stable mass and separated from the zone $Z_1$ by a zone $Z_3$ defined by a pseudo-plane potential slip surface whose position is relatively well known to persons skilled in the art and whose distance d from the back face $1_a$ increases going up from the bottom of the retaining wall 1 to its top, as represented by a curve in chain-dotted lines.

It should be assumed that the zones $Z_1$, $Z_2$, and $Z_3$ run along the entire length of the wall 1, and, so to speak, define volume zones that can be thought of as being sub-masses of the mass M.

The invention takes advantage of this observation that there exist zones $Z_1$, $Z_2$, and $Z_3$ upstream from the wall 1 to propose a reinforcing method which consists in connecting the back face $1_a$ of the wall 1 to the mass M by means of a plurality of reinforcing elements 5 which lie in substantially horizontal planes P corresponding to all or some of the rows $R_1$ to $R_4$. The reinforcing elements 5 can be allocated to some or all of the prefabricated modules 2 set up in columns as shown for the modules 2 in the rows $R_2$, $R_3$, and $R_4$.

Naturally, it should be understood that the reinforcing elements 5 can be installed as a function of the retaining requirements that are to be complied with, which is why only three reinforcing elements 5 are shown corresponding to the planes P of rows $R_2$, $R_3$, and $R_4$, it being understood that each row can have as many reinforcing elements 5 as there are modules, should that be justified.

In the method of the invention, the reinforcing elements 5 are placed in such a manner that each of them is connected by means of an attachment part 6 to a module 2 which is made or which includes for this purpose connection means for connecting to the attachment part 6. Such connection means are represented diagrammatically by chain-dotted lines, being given overall reference 7, and they can advantageously be constituted by an anchoring bar passing through appropriate slaping on the element 2 in question. In the example shown in FIG. 1, the bar 7 occupies a vertical direction.

According to another feature of the method, each reinforcing element 5 is designed to comprise a portion 8 that works in traction, which portion is of a length L that is always equal to or greater than the local distance d in the corresponding plane P between the back face of the wall 1 and the potential slip surface $Z_3$.

Figure 2:
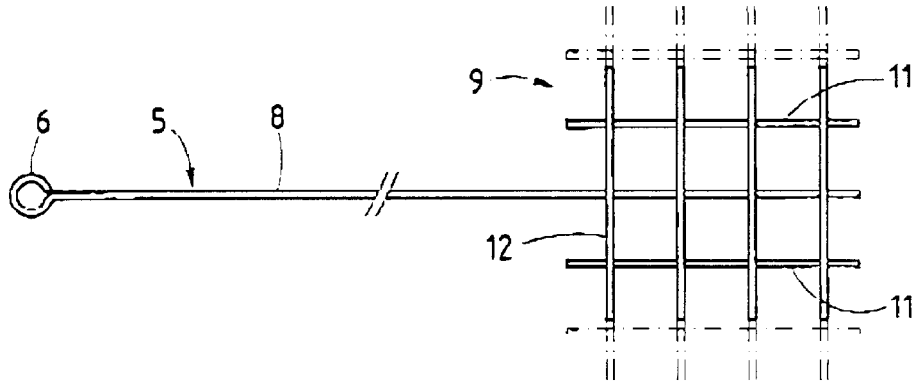
FIG. 2 is a plan view showing a reinforcing element of the invention.

In the method, each reinforcing element 5 is placed in such a manner than an anchoring portion 9 thereof is fully included in the strong zone $Z_2$. In the method of the invention, the anchoring portion 9 is constituted by a mesh as shown in FIG. 2 where there can be seen a reinforcing element 5 in plan view comprising the attachment portion 6 which is constituted by an eyelet, the portion 8 that works in traction which is constituted by a rigid bar, and the anchoring portion 9 which is constituted by a mesh for placing in the plane P corresponding to the level occupied by the element 5. It should be observed that according to an essential characteristic of the invention, the portion that works in traction is constituted by only some of the longitudinal bars making up the mesh and projecting beyond the mesh as far as the wall which is made up of the facing elements.

Figure 3:
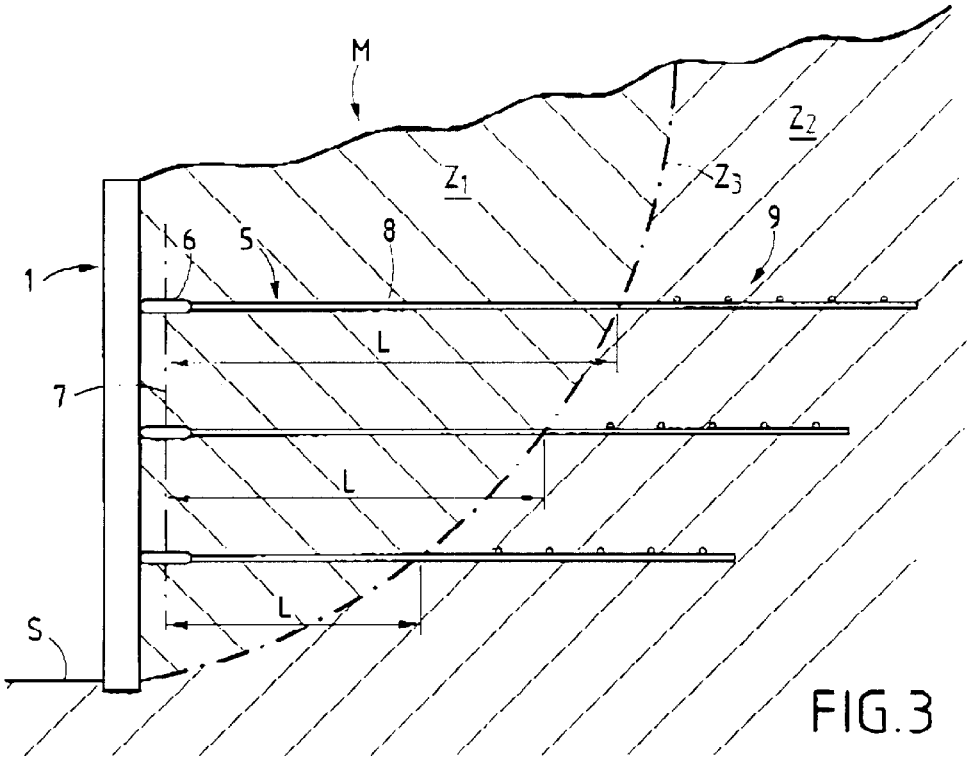
FIGS. 3 and 4 are two diagrammatic views analogous to FIG. 1 showing two ways of implementing the method.

In a disposition of the method of the invention, as shown in FIG. 3, reinforcing elements 5 are selected that have previously been made up as a function of knowledge concerning the local situation of the zone $Z_3$ so that the portion 8 working in traction is of a length L enabling it to meet the above requirement in each of the planes concerned.

Thus, as shown in FIG. 3, all of the reinforcing elements 5 occupying the plane P corresponding to the row $R_2$ have a respective portion 8 working in traction of a length that is shorter than the corresponding portion in each of the reinforcing elements situated in the plane immediately above, and so on up the entire height of the retaining wall.

Figure 4:
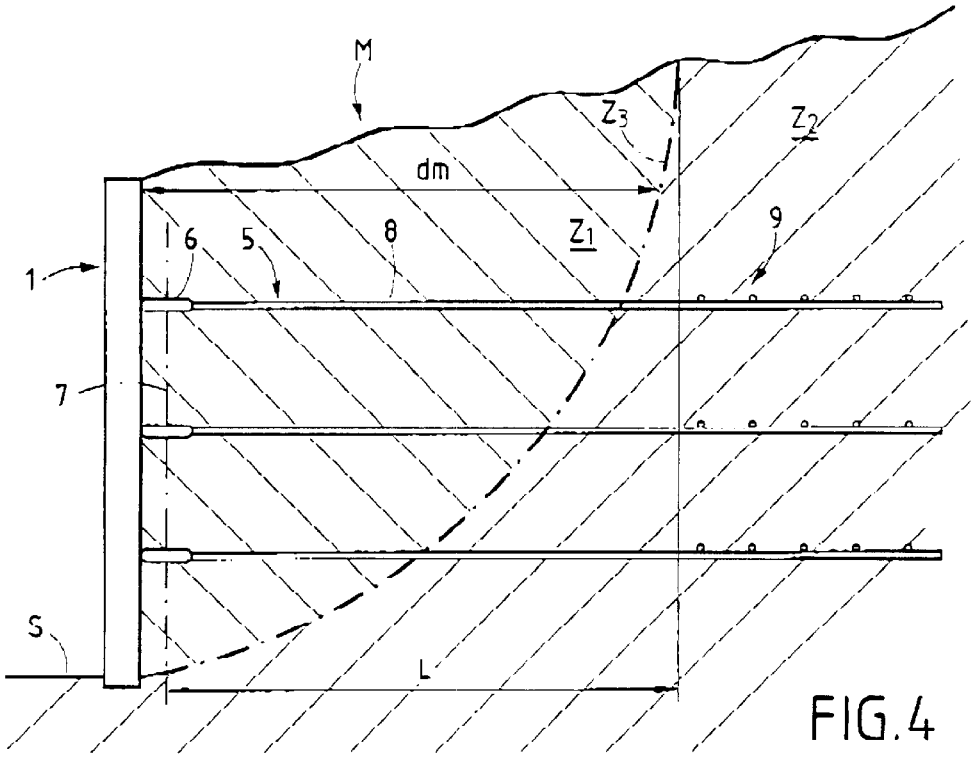

In the variant shown in FIG. 4, in contrast, all of the reinforcing elements 5, regardless of their position corresponding to the plane of one or other of the rows, present portions that work in traction all having the same length L, which length is selected so as always to be longer than the maximum distance dm that exists between the back face of the wall 1 and the zone $Z_3$ in the plane of the top surface of the fill 10.

FIG. 2 shows that the reinforcing element 5 can have an attachment part 6 constituted by an eyelet formed by a loop made out of the material constituting the rod or bar which constitutes the portion that works in traction. FIG. 2 shows that the bar constituting the portion 8 is also an integral portion of the mesh 9 which is advantageously constituted by two bar segments 11 extending parallel to and on either side of the bar 8 and by transverse bar segments 12 which are connected to said bar 8 and to the segments 11 by any suitable means.

Naturally, depending on anchoring conditions, the portion 9 can be constituted by a mesh that comprises a larger number of longitudinal bar segments 11 on either side of the bar 8, and connected thereto by at least four transverse bar segments 12.

Figure 5:
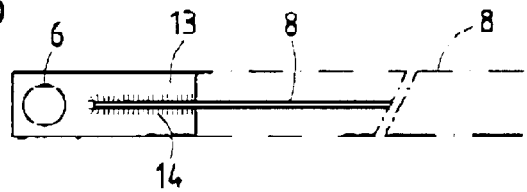
FIGS. 5, 6, and 7 are diagrammatic views showing variant embodiments of the reinforcement element of the invention.

FIG. 5 shows an eyelet 6 formed in a flat or strip 13 secured to the corresponding end portion of the bar 8 by welding 14, for example. As shown in chain-dotted lines, it should be observed that the strip 13 could itself constitute the bar 8, replacing it and being connected or incorporated in the mesh 9.

Figure 6:
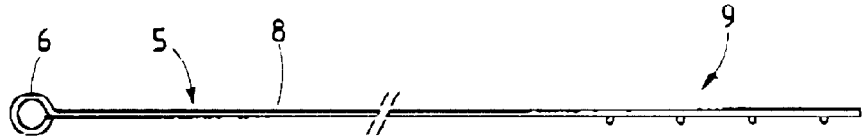

FIG. 6 shows another variant in which the eyelet 6 occupies a plane perpendicular to the plane of the mesh 9, unlike the embodiment of FIG. 2 where the eyelet 6 occupies a plane parallel thereto.

Such a disposition is advantageous when the connection means 7 are constituted by horizontal bars for interconnecting prefabricated modules that are juxtaposed in a common row.

Figure 7:
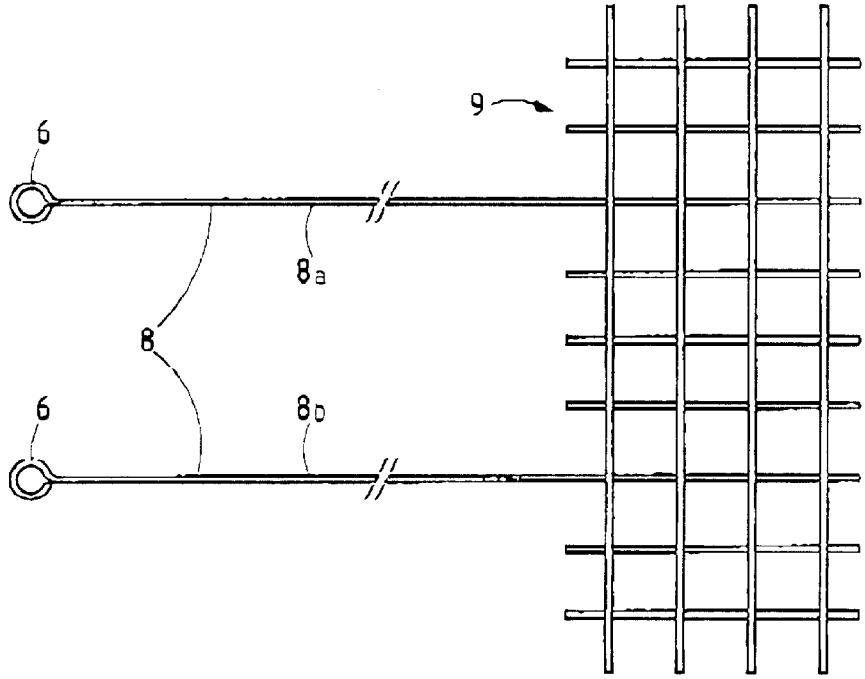

FIG. 7 shows another embodiment in which the portion working in traction is constituted by two bars $8_a$ and $8_b$ which extend preferably parallel to each other, each forming a respective eyelet 6 and each being connected to the mesh 9 which is then common to both bars $8_a$ and $8_b$. It should be observed that in this embodiment, each of the bars $8_a$ and $8_b$ is independent of the other where they constitute the portion that works in traction so as to avoid applying any stress to the zone $Z_1$. Nevertheless, the bars $8_a$ and $8_b$ could also be interconnected by spacers in their portions working in traction.

The anchor portion 9 could also be made like reinforcement for a beam, e.g. on the basis of three parallel members $13_1$, $13_2$, and $13_3$, two of which lie in the same plane, while the third is offset therefrom. The members $13_1$, $13_2$, and $13_3$ are interconnected by spacer cross-pieces 14 which, in the example shown in FIG. 8, are of triangular right cross-section.

Such a portion 9 can then be connected to a portion 8 which is made up of one bar or of two bars $8_a$, $8_b$ whose extensions constitute the members $13_1$ and $13_2$.

Figure 8:
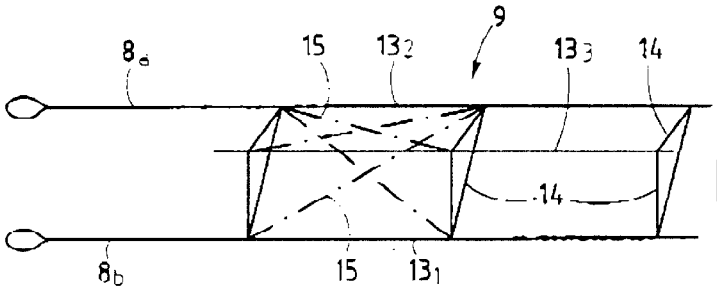
FIG. 8 is a diagrammatic perspective view on a different scale showing a variant embodiment.

FIG. 8 shows that it is advantageous in this embodiment to place triangulation bars 15 between the members $13_1$, $13_2$, and $13_3$ and the spacers 14 so as to form cross-bracing to reinforce the mechanical strength of the anchoring portion, in particular against the vertical stress exerted by the mass of filter material.

In preferred but non-exclusive manner, the retaining wall of the invention has its facing made with facing elements which, in accordance with the invention, are each provided with at least one rib on their respective back faces.

Figure 9:
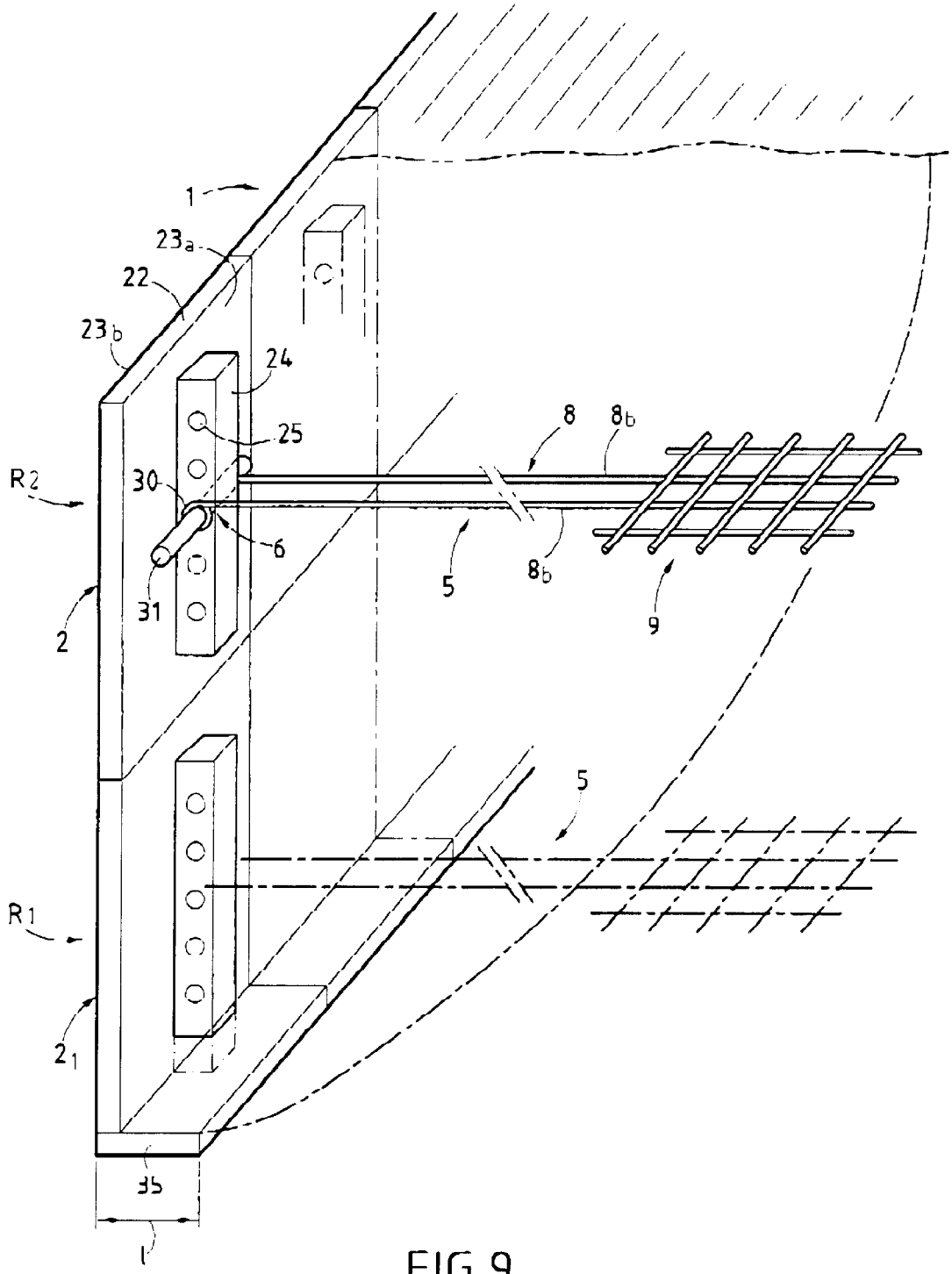
FIG. 9 is a fragmentary perspective view showing the wall of the invention.

FIG. 9 shows a retaining wall 1 constructed in accordance with the invention from facing elements such as panels 2 which are juxtaposed in horizontal rows such as $R_1$ and $R_2$ and which are also directly superposed from one row to the next. In the meaning of the invention, it should be considered that the retaining wall 1 could have more than two rows of panels 2 and that whatever the number of rows, the panels 2 could be offset from one row to the next, e.g. in a staggered bond.

In FIG. 9, each panel 2 is constituted by a web 22 that is thin relative to its height and its width. This thin thickness should be understood as lying in the range 8 cm to 14 cm. In conventional manner, the web 22 can be made of reinforced concrete, although that is not essential. The web 22 can be plane or curved, for example it could have a convex front face.

In addition to its web 22, each panel 2 has at least one rib 24 on its back face $\mathbf{23}_a$ projecting away from its front face $\mathbf{23}_b$, which rib preferably forms an integral portion of the web 22 and is made of the same reinforced material by means of reinforcement that is structurally connected to the reinforcement of the web 22. It should also be considered that the rib 24 could be made of a material that is different from that of the web 22. At intervals, the rib 24 possesses passages, and advantageously through holes 25, that extend in a direction perpendicular to the longitudinal axis of the rib 24, which rib preferably extends parallel to the height direction of the web 22. The rib 24 can extend over the full height of the panel, being flush with the top and bottom horizontal edges thereof, or on the contrary it can be of a shape that is set back from at least one of said edges. The passages 25 can also be formed by plastic of metal tubes projecting from the rib(s).

In the invention, the retaining wall 1 also has reinforcing elements 5 of the kind described above which are attached to the panels 2. In the example shown, the attachment part is formed by one or two eyelets 30 suitable for being threaded onto a transverse bar or tube 31 engaged through at least one of the holes 25. In the example shown in FIG. 9, the reinforcing elements 5 has two bars $\mathbf{8}_a$ and $\mathbf{8}_b$ constituting the portion 8 that works in traction, and each of them is provided with a respective eyelet 30. The bars $\mathbf{8}_a$ and $\mathbf{8}_b$ can thus be engaged on the two end portions of the cross-bar 31 projecting from both sides of the rib 24. The anchoring portion 9 of the reinforcing element 5 is advantageously constituted by a mesh of which the bars $\mathbf{8}_a$ and $\mathbf{8}_b$ constitute integral portions. It is preferable for the two bars $\mathbf{8}_a$ and $\mathbf{8}_b$ to be spaced apart by a distance that is substantially equal to the width of the rib 24. This ensures that the eyelets 30 are located on either side of the rib 24 and close thereto, thereby contributing to reducing the bending moment to which the bar 31 is subjected. This enables its dimensions to be reduced, both in terms of diameter and in terms of thickness if it is constituted by a tube.

Erecting a retaining wall 1 thus consists in laying a first row such as $R_1$ of panels 2 directly on the ground or via a suitable foundation and in connecting at least some of the panels 2 to reinforcing elements 5 that extend horizontally so as to be inserted via their portions 9 in the backfill which is built up progressively.

This process is repeated for each of the rows with the number of reinforcing elements being chosen to match the nature of the backfill and/or the characteristics of the mass M.

Figure 10:
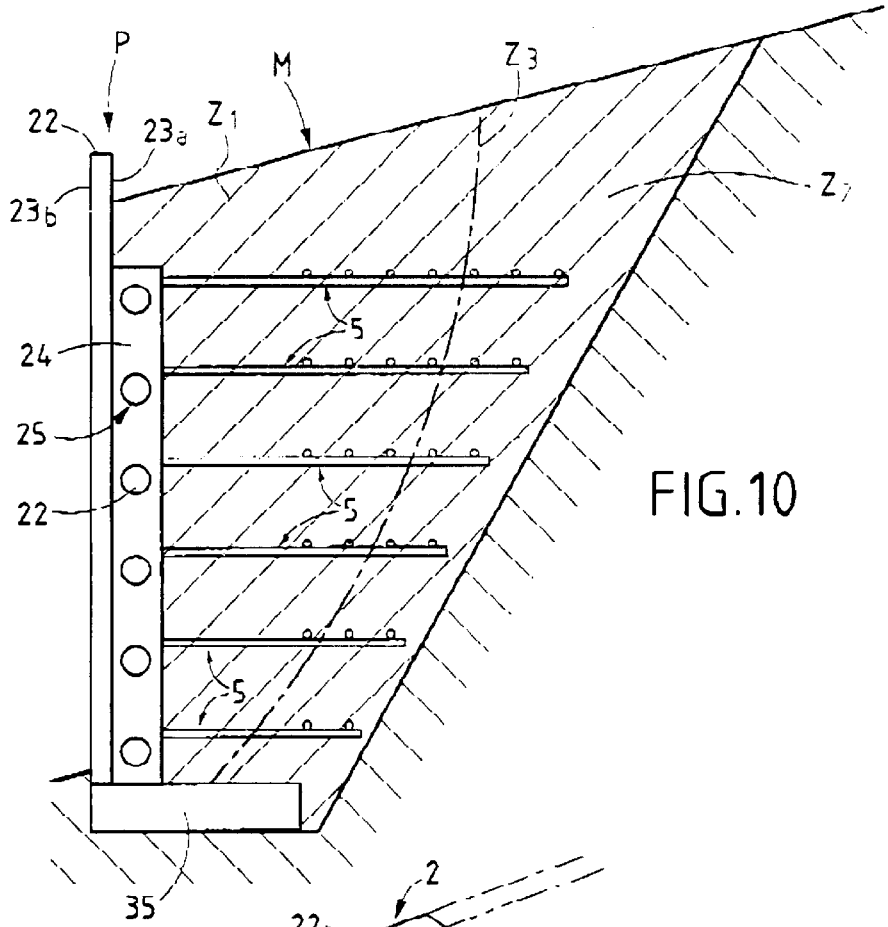
FIG. 10 is a fragmentary view on a different scale showing a variant structural disposition of the wall.

FIG. 10 shows that it can be advantageous to proceed as described above while nevertheless fitting each panel 2 with as many reinforcing elements 5 as the rib 24 possesses holes 25. It can thus be envisaged to install reinforcing elements 5 of substantially equal length L at each of the levels in question, such that in all cases the anchoring portion 9 is situated at least in part in a strong zone of the backfill, such as the zone $Z_2$.

Figure 11:
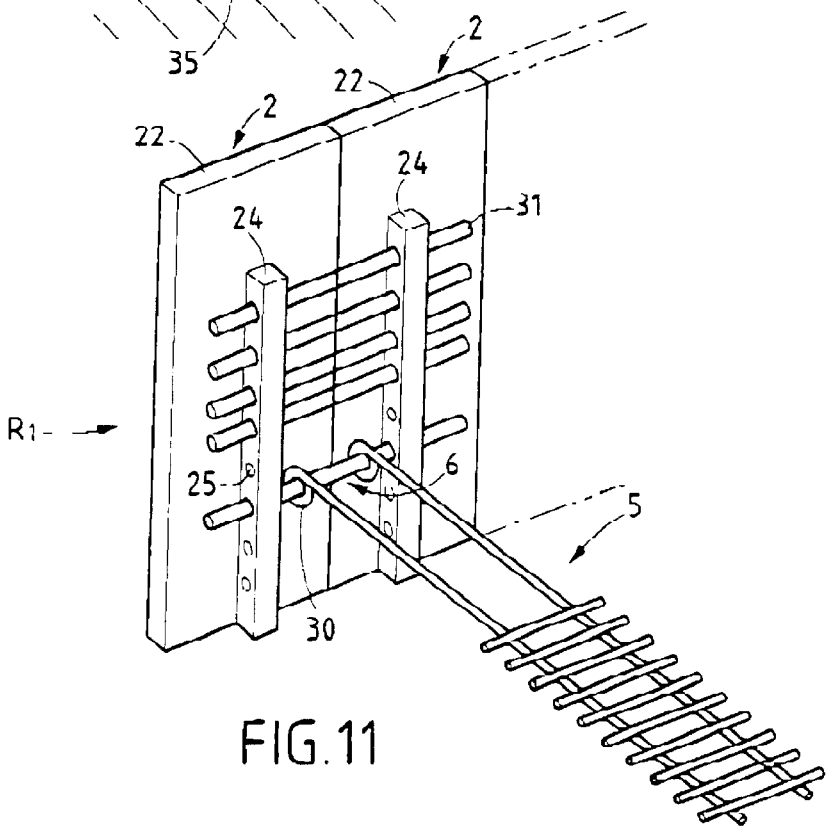
FIGS. 11 and 12 are fragmentary perspective views on different scales showing two other variant implementations of the invention.

In the invention, and as shown in FIG. 11, it is also possible to envisage connecting together two panels 2 set up side by side in a common row such as the row $R_1$ by means of at least one bar 31 serving not only to produce a connection with a reinforcing element 5 but also to join together the panels by being engaged through the holes 25 in the ribs 24 of both panels 2. Under such circumstances, and as shown in FIG. 11, it is advantageous for the eyelets 30 then to be engaged on the bar 31 so as to co-operate with the portion thereof that extends between the ribs 24 of the two juxtaposed panels 2.

Figure 12:
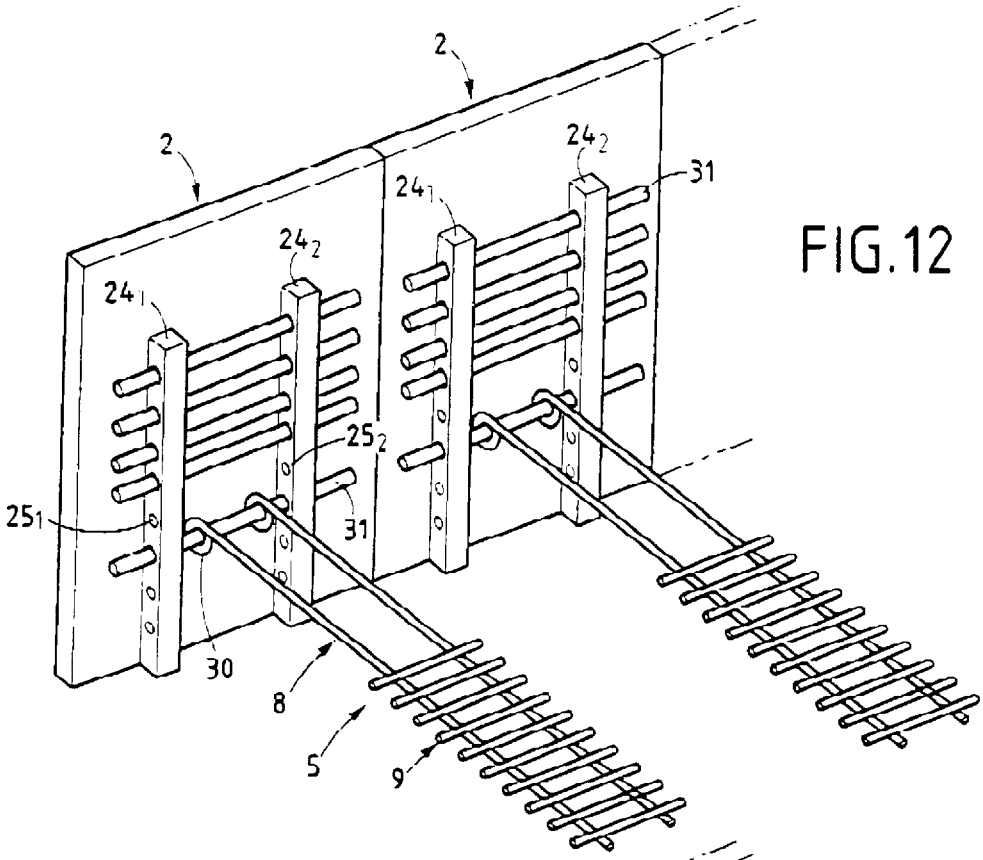

In another disposition of the invention, as shown in FIG. 12, each panel 2 has two parallel ribs $\mathbf{24}_1$ and $\mathbf{24}_2$ which are preferably situated symmetrically on either side of a plane of symmetry parallel to the height of the web 22. In such a structure, the ribs $\mathbf{24}_1$ and $\mathbf{24}_2$ possess holes $\mathbf{25}_1$ and $\mathbf{25}_2$ that coincide, thus enabling at least one transverse bar 31 to be put into place passing through one or both eyelets 30 of a reinforcing element 5, as in the example of FIG. 11.

Figure 13:
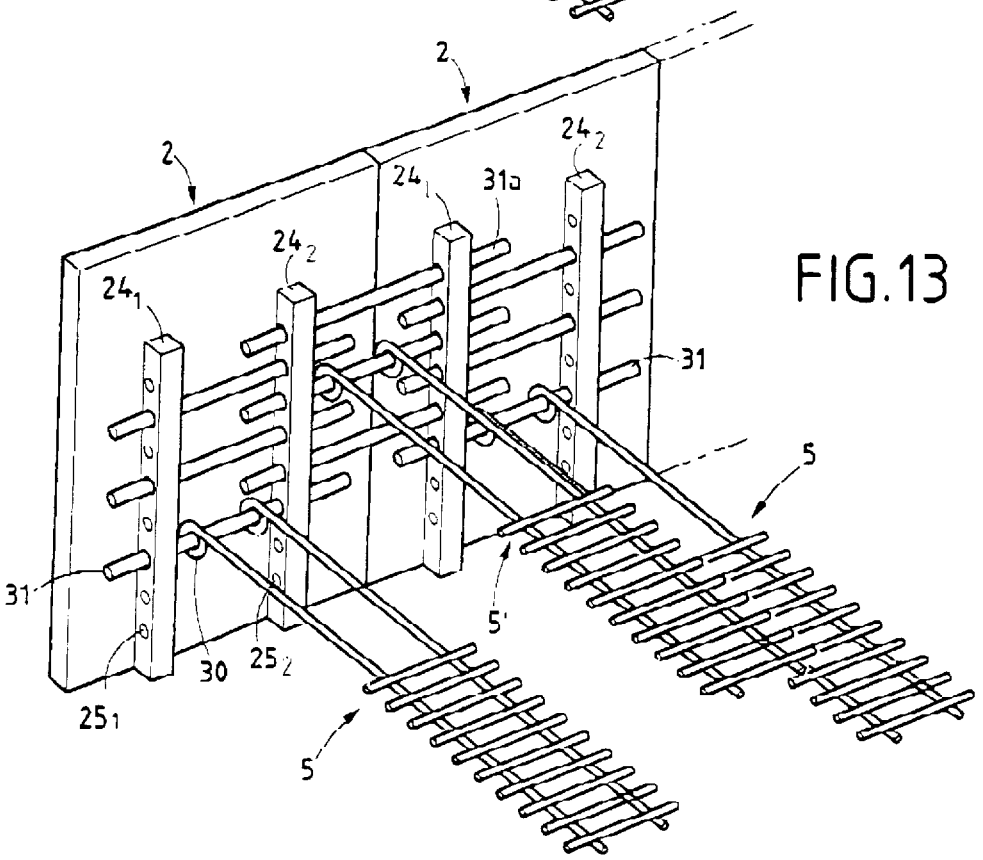
FIGS. 13 and 14 are diagrammatic views showing two other variant implementations.

FIG. 13 shows that starting from a panel of the kind shown in FIG. 12, it is possible to make use of the holes $\mathbf{25}_1$ and $\mathbf{25}_2$ in two ribs $\mathbf{24}_1$ and $\mathbf{24}_2$ to attach one or more reinforcing elements 5 and also to place at least one transverse bar such as $\mathbf{31}_a$ that also acts as a junction element, e.g. between the rib $\mathbf{24}_2$ of a panel 2 and the rib $\mathbf{24}_1$ of an adjacent panel 2 in the same row. The transverse bar $\mathbf{31}_a$ can also be used to perform two functions by having a reinforcing element such as the element 5' attached thereto.

FIGS. 9 and 10 show that it can also be advantageous to make the prefabricated panel of the invention in such a manner as to incorporate a footing 35 of width l, measured perpendicularly to the plane of the back face, which is close to 15% to 25% of the height of the web 22.

A panel constructed in this way and given reference 2 can advantageously serve to ensure that the row $R_1$ or $R_2$ is automatically stable by constituting a bearing surface contributing to strength and stability while the reinforcing elements are being put into place, as shown in FIG. 10.

Figure 14:
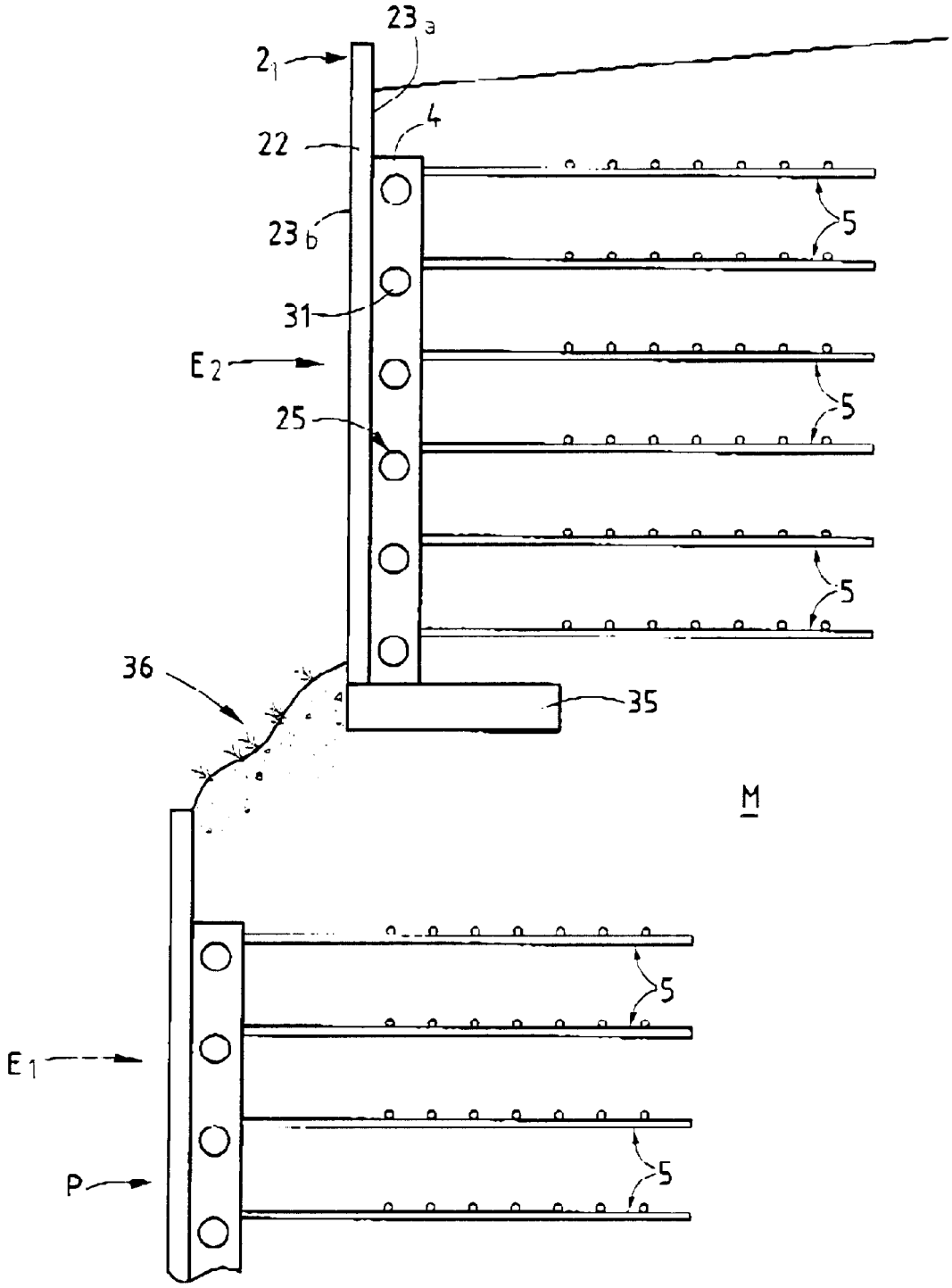

FIG. 14 shows that with such an embodiment it becomes possible with panels 2 to make up a retaining wall whose facing is stepped $E_1$, $E_2$, . . . going back towards the mass M, thereby leaving niches or berms 36 enabling plants to improve the appearance of the facing made in this way. In preferred but not strictly necessary manner, each panel can be of a height that is substantially equal to the facing for each step or stage $E_1$, $E_2$, . . . , of the retaining wall.

What is claimed is:

1. A method of constructing a retaining wall from a reinforced mass, the wall comprising a facing made up of juxtaposed component elements in front of a mass to be retained, which mass comprises immediately behind the facing an "active" zone behind which there is a "strong" zone, the two zones being considered as meeting in a boundary zone defined by a pseudo-plane potential slip surface whose distance d from the back face of the facing increases going from the base to the top of the retaining wall, the method comprising the steps of:

selecting a plurality of reinforcing elements in such a manner that each reinforcing element comprises a mesh comprising more than two member bars linked by transverse bars and with only some of the member bars extending out of the mesh and presenting remote from the mesh an attachment part, connecting the back face of the facing to the strong zone by means of the reinforcing elements disposed in superposed planes, the mesh of each reinforcing element being included in the strong zone and forming an anchoring portion, the attachment parts of the reinforcing element being connected to the facing and the part of the member bars extending between the attachment to the facing and the mesh forming a working portion that works in traction.

2. The method according to claim 1, wherein the length of the working portion of the reinforcing elements is not less than the greatest distance between the back face of the facing and the slip surface.

3. The method according to claim 1, wherein the working portion of the reinforcing elements comprises at least one and at most two member bars.

4. The method according to claim 1 wherein the anchoring portions of the reinforcing elements are disposed substantially horizontally.

5. A reinforcing element for a retaining wall, said retaining wall comprising:

a facing that is to be connected to a mass to be retained comprising an "active" zone behind which there is a "strong" zone, the reinforcing element comprises an anchoring portion to be included in the strong zone and formed by a mesh comprising more than two member bars linked by transverse bars and with only some of the member bars extending out of the mesh and presenting remote from the mesh, an attachment part to be fixed to the facing, the part of the member bars extending between the attachment part and the mesh forming a working portion intended to work in traction.

6. The reinforcing element according to claim 5, wherein the working portion that works comprises only one member bar.

7. The reinforcing element according to claim 5, wherein the working portion comprises only two parallel member bars which are not interconnected.

8. The reinforcing element according to claim 5, wherein the attachment part defines an eyelet suitable for receiving an anchoring bar belonging.

9. The reinforcing element according to claim 8, wherein the plane of the eyelet of the attachment part is parallel to the plane of the mesh.

10. The reinforcing element according to claim 8, wherein the plane of the eyelet of the attachment part is orthogonal to the plane of the mesh.

11. The reinforcing element according to claim 8, wherein the eyelet is constituted by a loop.

12. The reinforcing element according to claim 8, wherein the eyelet is constituted by a hole formed through a strip.

13. The reinforcing element according to claim 5, wherein the anchoring portion is in the form of a beam constituted by a plurality of member bars interconnected by transverse spacer bars.

14. The reinforcing element according to claim 13, characterized in that triangulation bars interconnect the member bars and the transverse spacer bars.

15. The reinforcing element according to claim 5 wherein the length of the working portion is not less than the distance between the facing and the strong zone.

16. A retaining wall of the type comprising prefabricated elements that are juxtaposed horizontally and vertically to form a facing connected to a mass to be supported in front of a strong zone by reinforcing elements inserted in said mass and strong zone, wherein:

each prefabricated element comprises a plate or panel possessing a front face and a back face from which there projects at least one rib having through holes on axes orthogonal to that of the rib, each reinforcing element comprises an anchoring portion to be included in the strong zone and formed by a mesh comprising more than two member bars linked by transverse bars and with only some of the member bars extending out of the mesh and presenting remote from the mesh an attachment part to be fixed to the facing, the part of the member bars extending between the attachment part and the mesh forming a working portion intended to work in traction, at least one second transverse bar is engaged through at least one hole in a rib of at least one element so as to extend on either side of said rib, and at least one reinforcing element is secured at least to said bar by its attachment part so as to extend substantially horizontally away from the back face and so as the anchoring mesh of the reinforcement element is inserted in the strong zone.

17. The retaining wall according to claim 16, wherein that at least some of the prefabricated elements have at least two parallel ribs on their back faces.

18. The retaining wall according to claim 16, characterized in that the bar is engaged through the holes in the ribs of at least two contiguous elements so as to perform a second function of joining said elements together.

19. The retaining wall according to claim 16, wherein two contiguous elements lying in a common plane and substantially in horizontal alignment at least their bottoms, are connected to a common reinforcing element.

20. The retaining wall according to claim 16, characterized in that at least some of the elements include a footing extending perpendicularly to the plane of the back face over a distance lying in the range 15% to 25% of the height of the element.

21. The retaining wall according to claim 16, characterized in that at least some of the elements constituting the facing are connected to one another when occupying a common substantially horizontal row by transverse bars at least some of which also serve for attachment of reinforcing elements.

22. The retaining wall according to claim 16, characterized in that it is made up of substantially horizontal and superposed rows of prefabricated elements, at least some of which are connected to the strong zone by reinforcing elements, at least one of said rows other than the bottom row being stepped back relative to the row immediately beneath it so as to define a berm.

* * * * *